US007064277B1

(12) United States Patent
Lique et al.

(10) Patent No.: US 7,064,277 B1
(45) Date of Patent: Jun. 20, 2006

(54) REDUCED ALIEN CROSSTALK ELECTRICAL CABLE

(75) Inventors: Roger Lique, Standford, KY (US); Asef Baddar, Independence, KY (US); Thomas McLaughlin, Taylor Mill, KY (US); Mike Doorhy, Mokena, IL (US); David Hawkins, Sugar Hill, GA (US)

(73) Assignees: General Cable Technology Corporation, Highland Heights, KY (US); Panduit Corporation, Tinley Park, IL (US)

( * ) Notice: Subject to any disclaimer, the term of this patent is extended or adjusted under 35 U.S.C. 154(b) by 0 days.

(21) Appl. No.: 11/012,149

(22) Filed: Dec. 16, 2004

(51) Int. Cl.
*H01B 7/00* (2006.01)

(52) U.S. Cl. ..... 174/113 C

(58) Field of Classification Search ..... 174/113 R, 174/113 C, 131 A, 115, 27
See application file for complete search history.

(56) References Cited

U.S. PATENT DOCUMENTS

| | | | |
|---|---|---|---|
| 290,881 | A | 12/1883 | Hyde |
| 483,285 | A | 9/1892 | Guilleaume |
| 1,780,564 | A | 11/1930 | Oxer |
| 1,883,269 | A | 10/1932 | Yonkers |
| 1,976,847 | A | 10/1934 | Gordon et al. |
| 2,125,869 | A | 8/1938 | Atkinson |
| 2,455,773 | A | 12/1948 | Johnson |
| 2,538,019 | A | 1/1951 | Lee |
| 2,583,026 | A | 1/1952 | Swift |
| 2,665,322 | A | 1/1954 | MacDonald |
| RE24,154 | E | 5/1956 | Krueger |
| 2,804,494 | A | 9/1957 | Fenton |
| 2,847,499 | A | 8/1958 | Peterson |
| 3,005,739 | A | 10/1961 | Lang et al. |
| 3,032,604 | A | 5/1962 | Timmons |
| 3,086,557 | A | 4/1963 | Peterson |
| 3,102,160 | A | 8/1963 | Cook et al. |
| 3,131,469 | A | 5/1964 | Glaze |
| 3,209,064 | A | 9/1965 | Cutler |
| 3,234,722 | A | 2/1966 | Gilmore |
| 3,274,329 | A | 9/1966 | Timmons |
| 3,622,683 | A | 11/1971 | Roberts et al. |
| 3,649,434 | A | 3/1972 | Mortenson |
| 3,649,744 | A | 3/1972 | Coleman |
| 3,650,862 | A | 3/1972 | Burr |
| 3,715,458 | A | 2/1973 | Bayes et al. |
| 3,761,842 | A | 9/1973 | Gandrud |
| 3,803,340 | A | 4/1974 | Jachimowiczm et al. |
| 3,881,052 | A | 4/1975 | Britz et al. |
| 3,911,200 | A | 10/1975 | Simons et al. |
| 3,921,381 | A | 11/1975 | Vogelsberg |
| 3,992,566 | A | 11/1976 | Kerimov et al. |
| 4,010,213 | A | 3/1977 | Naegeli |

(Continued)

FOREIGN PATENT DOCUMENTS

| | | |
|---|---|---|
| EP | 0 302 162 | 4/1995 |
| FR | 694100 | 11/1930 |
| GB | 1 390 152 | 4/1975 |
| JP | 063493344 A | |

* cited by examiner

*Primary Examiner*—Chau N. Nguyen
(74) *Attorney, Agent, or Firm*—Blank Rome LLP

(57) ABSTRACT

A cable includes a plurality of twisted pairs of insulated conductors, and an insulating cable jacket that has a central longitudinal axis encloses the twisted pairs of insulated conductors. The cable jacket defines an inner perimeter that surrounds the twisted pairs of insulated conductors that is substantially circular in section transverse to the central longitudinal axis and an outer perimeter that is substantially non-circular in section transverse to the central longitudinal axis. The outer perimeter includes at least one raised area for maintaining spacing from an adjacent cable, thereby reducing alien crosstalk.

11 Claims, 1 Drawing Sheet

U.S. PATENT DOCUMENTS

| | | | | |
|---|---|---|---|---|
| 4,034,148 | A | 7/1977 | Lang | |
| 4,041,237 | A | 8/1977 | Stine et al. | |
| 4,081,602 | A | 3/1978 | Paniri et al. | |
| 4,085,284 | A | 4/1978 | Olszewski et al. | |
| 4,131,690 | A | 12/1978 | Jukes et al. | |
| 4,165,442 | A | 8/1979 | Gabriel et al. | |
| 4,181,815 | A | 1/1980 | Lundberg et al. | |
| 4,218,581 | A | 8/1980 | Suzuki | |
| 4,234,759 | A | 11/1980 | Harlow | |
| 4,262,164 | A | 4/1981 | Nutt et al. | |
| 4,319,940 | A | 3/1982 | Arroyo et al. | |
| 4,340,771 | A | 7/1982 | Watts | |
| 4,356,345 | A | 10/1982 | Gonia | |
| 4,368,214 | A | 1/1983 | Gillette | |
| 4,393,582 | A | 7/1983 | Arnold, Jr. et al. | |
| 4,394,705 | A | 7/1983 | Blachman | |
| 4,404,424 | A | 9/1983 | King et al. | |
| 4,412,094 | A | 10/1983 | Dougherty et al. | |
| 4,449,012 | A | 5/1984 | Voser | |
| 4,453,031 | A | 6/1984 | Justiss | |
| 4,467,138 | A | 8/1984 | Brorein | |
| 4,468,089 | A | 8/1984 | Brorein | |
| 4,481,379 | A | 11/1984 | Bolick, Jr. et al. | |
| 4,486,619 | A | 12/1984 | Trine et al. | |
| 4,487,992 | A | 12/1984 | Tomita | |
| 4,500,748 | A | 2/1985 | Klein | |
| 4,515,993 | A | 5/1985 | MacKenzie | |
| 4,541,980 | A | 9/1985 | Kiersarsky et al. | |
| 4,550,559 | A | 11/1985 | Thomson | |
| 4,570,477 | A | 2/1986 | Sugibuchi | |
| 4,588,852 | A | 5/1986 | Fetterolf et al. | |
| 4,595,793 | A | 6/1986 | Arroyo et al. | |
| 4,605,818 | A | 8/1986 | Arroyo et al. | |
| 4,697,051 | A | 9/1987 | Beggs et al. | |
| 4,711,811 | A | 12/1987 | Randa | |
| 4,755,629 | A | 7/1988 | Beggs et al. | |
| 4,761,053 | A | 8/1988 | Cogelia et al. | |
| 4,767,890 | A | 8/1988 | Magnan | |
| 4,777,325 | A | 10/1988 | Siwinski | |
| 4,800,236 | A | 1/1989 | Lemke | |
| 4,873,393 | A | 10/1989 | Friesen et al. | |
| 4,933,513 | A | 6/1990 | Lee | |
| 4,941,729 | A | 7/1990 | Hardin et al. | |
| 4,963,609 | A | 10/1990 | Anderson et al. | |
| 5,010,210 | A | 4/1991 | Sidi et al. | |
| 5,015,800 | A | 5/1991 | Vaupotic et al. | |
| 5,038,002 | A * | 8/1991 | Viaud | 174/115 |
| 5,103,067 | A | 4/1992 | Aldissi | |
| 5,132,488 | A | 7/1992 | Tessier et al. | |
| 5,142,100 | A | 8/1992 | Vaupotic | |
| 5,155,304 | A | 10/1992 | Gossett et al. | |
| 5,162,609 | A | 11/1992 | Adriaenssens et al. | |
| 5,202,946 | A | 4/1993 | Hardin et al. | |
| 5,245,134 | A | 9/1993 | Vana, Jr. et al. | |
| 5,253,317 | A | 10/1993 | Allen et al. | |
| 5,283,390 | A | 2/1994 | Hubis et al. | |
| 5,286,923 | A | 2/1994 | Prudhon et al. | |
| 5,298,680 | A | 3/1994 | Kenny | |
| 5,342,991 | A | 8/1994 | Xu et al. | |
| 5,367,971 | A | 11/1994 | Carpenter et al. | |
| 5,376,758 | A | 12/1994 | Kimber | |
| 5,393,933 | A | 2/1995 | Goertz | |
| 5,399,813 | A | 3/1995 | McNeill et al. | |
| 5,401,908 | A | 3/1995 | Rodeghero | |
| 5,424,491 | A | 6/1995 | Walling et al. | |
| 5,434,354 | A | 7/1995 | Baker et al. | |
| 5,448,669 | A | 9/1995 | Dunn et al. | |
| 5,448,670 | A | 9/1995 | Blew et al. | |
| 5,493,071 | A | 2/1996 | Newmoyer | |
| 5,514,837 | A | 5/1996 | Kenny et al. | |
| 5,525,757 | A | 6/1996 | O'Brien | |
| 5,541,361 | A | 7/1996 | Friesen et al. | |
| 5,544,270 | A | 8/1996 | Clark et al. | |
| 5,574,250 | A | 11/1996 | Hardie et al. | |
| 5,606,151 | A | 2/1997 | Siekierka et al. | |
| 5,734,126 | A | 3/1998 | Siekierka et al. | |
| 5,742,002 | A | 4/1998 | Arredondo et al. | |
| 5,744,757 | A | 4/1998 | Kenny et al. | |
| 5,767,441 | A | 6/1998 | Brorein et al. | |
| 5,770,820 | A | 6/1998 | Nelson et al. | |
| 5,789,711 | A | 8/1998 | Gaeris et al. | |
| 5,814,768 | A | 9/1998 | Wessels et al. | |
| 5,821,467 | A | 10/1998 | O'Brien et al. | |
| 5,834,697 | A | 11/1998 | Baker et al. | |
| 5,900,588 | A | 5/1999 | Springer et al. | |
| 5,902,962 | A | 5/1999 | Gazdzinski | |
| 5,932,847 | A | 8/1999 | Mayfield | |
| 5,936,205 | A | 8/1999 | Newmoyer | |
| 5,952,607 | A | 9/1999 | Friesen et al. | |
| 5,952,615 | A | 9/1999 | Prudhon | |
| 5,956,445 | A | 9/1999 | Deitz, Sr. et al. | |
| 5,969,295 | A | 10/1999 | Boucino et al. | |
| 5,990,419 | A * | 11/1999 | Bogese, II | 174/120 R |
| 6,037,546 | A | 3/2000 | Mottine et al. | |
| 6,064,008 | A | 5/2000 | Craton | |
| 6,066,799 | A | 5/2000 | Nugent | |
| 6,101,305 | A | 8/2000 | Wagman et al. | |
| 6,139,957 | A | 10/2000 | Craton | |
| 6,150,612 | A | 11/2000 | Grandy et al. | |
| 6,153,826 | A | 11/2000 | Kenny et al. | |
| 6,162,992 | A | 12/2000 | Clark et al. | |
| 6,194,663 | B1 | 2/2001 | Friesen et al. | |
| 6,211,467 | B1 | 4/2001 | Berelsman et al. | |
| 6,222,129 | B1 | 4/2001 | Siekierka et al. | |
| 6,222,130 | B1 | 4/2001 | Gareis et al. | |
| 6,248,954 | B1 * | 6/2001 | Clark et al. | 174/113 R |
| 6,255,593 | B1 | 7/2001 | Reede | |
| 6,288,340 | B1 | 9/2001 | Arnold | |
| 6,300,573 | B1 | 10/2001 | Horie et al. | |
| 6,303,867 | B1 * | 10/2001 | Clark et al. | 174/113 R |
| 6,310,295 | B1 | 10/2001 | Despard | |
| 6,323,427 | B1 | 11/2001 | Rutledge | |
| 6,353,177 | B1 | 3/2002 | Young | |
| 6,433,272 | B1 | 8/2002 | Buhler et al. | |
| 6,452,105 | B1 | 9/2002 | Badii et al. | |
| 6,465,737 | B1 | 10/2002 | Bonato et al. | |
| 6,476,326 | B1 | 11/2002 | Fuzier et al. | |
| 6,506,976 | B1 | 1/2003 | Neveux, Jr. | |
| 6,534,715 | B1 | 3/2003 | Maunder et al. | |
| 6,545,222 | B1 | 4/2003 | Yokokawa et al. | |
| 6,566,605 | B1 | 5/2003 | Prudhon | |
| 6,566,607 | B1 | 5/2003 | Walling | |
| 6,570,095 | B1 | 5/2003 | Spruell et al. | |
| 6,573,456 | B1 | 6/2003 | Spruell et al. | |
| 6,624,359 | B1 | 9/2003 | Glew et al. | |
| 6,639,152 | B1 | 10/2003 | Glew et al. | |
| 6,743,983 | B1 | 6/2004 | Wiekhorst et al. | |
| 6,770,819 | B1 | 8/2004 | Patel | |
| 6,812,408 | B1 | 11/2004 | Clark et al. | |
| 2001/0040042 | A1 | 11/2001 | Stipes | |
| 2002/0079126 | A1 | 6/2002 | Valenzuela | |
| 2003/0106704 | A1 * | 6/2003 | Isley et al. | 174/113 R |
| 2003/0121695 | A1 | 7/2003 | Wiebelhaus et al. | |
| 2003/0217863 | A1 | 11/2003 | Clark et al. | |
| 2004/0035603 | A1 | 2/2004 | Clark et al. | |
| 2004/0055777 | A1 | 3/2004 | Wiekhorst et al. | |
| 2004/0055779 | A1 | 3/2004 | Wiekhorst et al. | |
| 2004/0118593 | A1 | 6/2004 | Augustine et al. | |
| 2005/0006132 | A1 * | 1/2005 | Clark | 174/113 C |
| 2005/0133246 | A1 | 6/2005 | Parke et al. | |

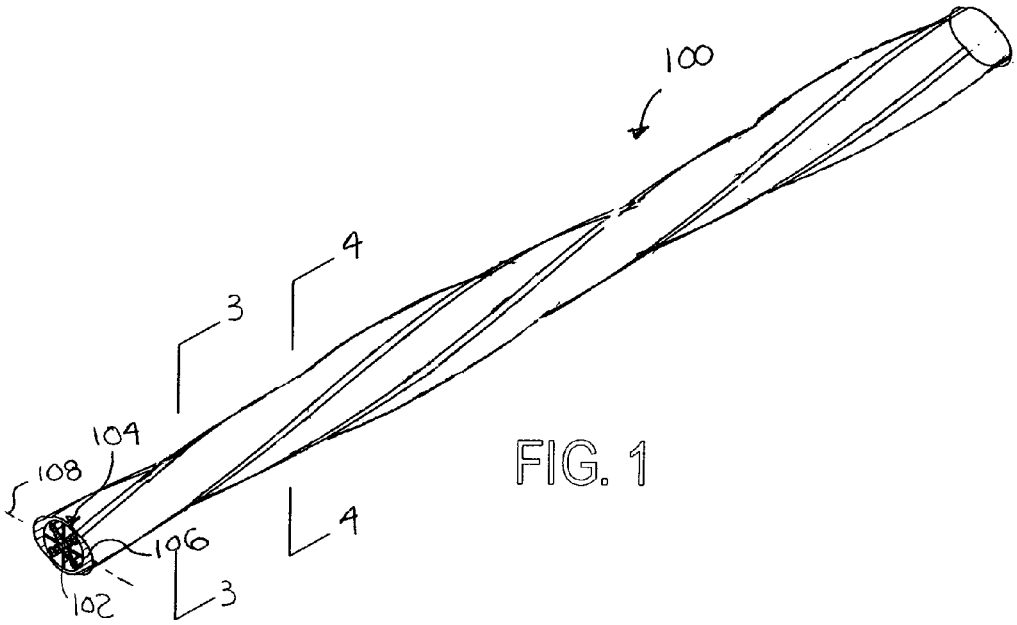
FIG. 1
FIG. 2
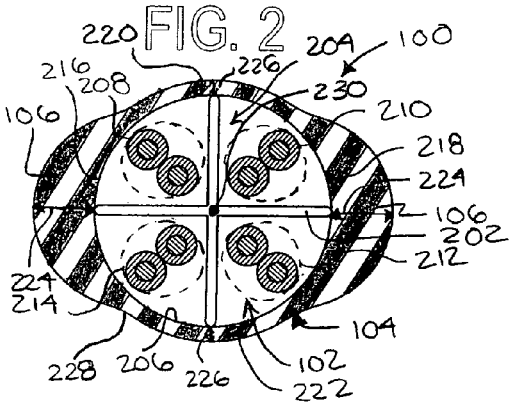
FIG. 3
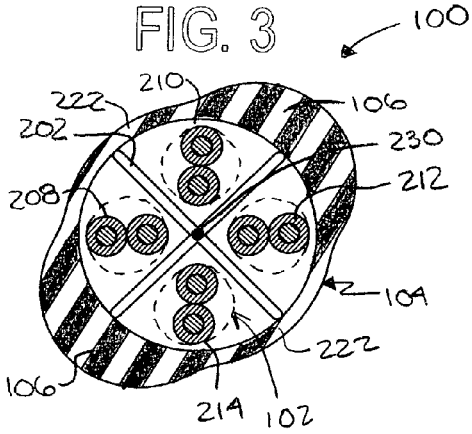
FIG. 4
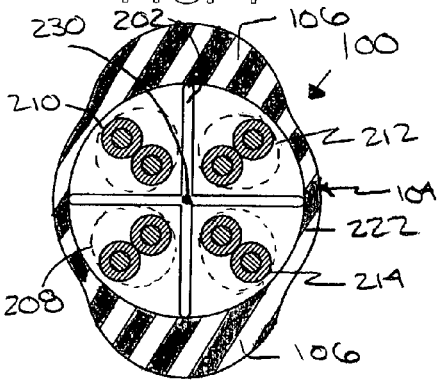
FIG. 5
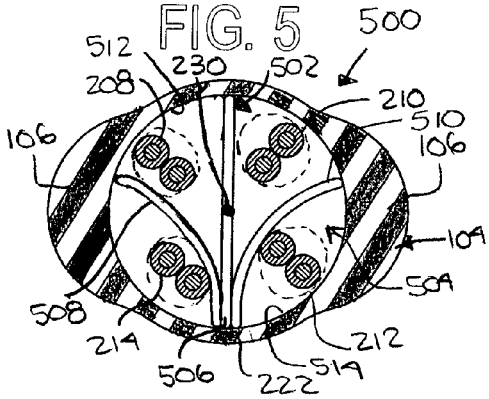

REDUCED ALIEN CROSSTALK ELECTRICAL CABLE

FIELD OF THE INVENTION

The present invention relates to an electrical cable that reduces alien crosstalk between cables. More specifically, the shape and thickness of the cable jacket of the electrical cable reduces alien crosstalk between adjacent cables.

BACKGROUND OF THE INVENTION

Interference between electrical cables bundled together in a cabling system decreases the efficiency of data transmission by the cabling system. Alien near-end crosstalk (ANEXT) and alien far-end crosstalk (AFEXT) noise is caused by the unbalance between the twisted pairs of insulated conductors of adjacent cables. ANEXT and AFEXT are transmission noises that can increase the signal to noise ratio (SNR) and bit error rate (BER) in a cable transmission system, such as for a local area network.

Specifically, ANEXT and AFEXT occur when some of the signal current in a twisted pair of one cable couples with another twisted pair of another cable external to the signal path and along the path of a circuit between the two pairs. That noise corrupts the signal in the twisted pair external to the original signal path. When the circuit between the noise emitting and receiving twisted pairs egresses one cable boundary and crosses another cable boundary, the noise becomes alien crosstalk.

SUMMARY OF THE INVENTION

According to the present invention a cable is provided that includes a plurality of twisted pairs of insulated conductors and an insulating cable jacket that has a central longitudinal axis that encloses the twisted pairs of insulated conductors. The cable jacket defines an inner perimeter that surrounds the twisted pairs of insulated conductors that is substantially circular in section transverse to the central longitudinal axis and an outer perimeter that is substantially non-circular in section transverse to the central longitudinal axis. The outer perimeter includes at least one raised area for maintaining spacing from an adjacent cable, thereby reducing alien crosstalk.

The present invention also provides a cable including first and second twisted pairs of insulated conductors and an insulating cable jacket that has a central longitudinal axis and encloses the first and second twisted pairs of insulated conductors. The cable jacket defines an inner perimeter surrounding the first and second twisted pairs of insulated conductors that is substantially circular in section transverse to the central longitudinal axis and an outer perimeter that is substantially non-circular in section transverse to the central longitudinal axis. The outer perimeter includes a first raised area for maintaining spacing from an adjacent cable, thereby reducing alien crosstalk. The insulating cable jacket is twisted about the central longitudinal axis so that the first raised area extends around the insulating cable jacket. A separate dielectric separator is received in the insulated cable jacket and disposed between the first and second pairs of insulated conductors for reducing crosstalk between the first and second pairs of insulated conductors.

Advantages and salient features of the invention will become apparent from the following detailed description, which, taken in conjunction with the annexed drawings, discloses preferred embodiments of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a drawing of a perspective view of the electrical cable in accordance with a first embodiment of the present invention;

FIG. 2 is a drawing of an end elevational view in section of the electrical cable illustrated in FIG. 1, showing a first orientation of raised areas of a cable jacket of the cable;

FIG. 3 is a drawing of an elevational view of the electrical cable illustrated in FIG. 1 taken in section along line 3—3 of FIG. 1, showing a second orientation of the raised areas of the cable jacket after the cable is twisted;

FIG. 4 is a drawing of an elevational view of the electrical cable illustrated in FIG. 1 taken in section along line 4—4 of FIG. 1, showing a third orientation of the raised areas of the cable jacket after the cable is twisted; and FIG. 5 is a drawing of an elevational view in section of an electrical cable in accordance with a second embodiment of the present invention.

DETAILED DESCRIPTION OF THE INVENTION

Referring to FIGS. 1–4, an electrical cable 100 according to a first embodiment of the present invention includes a plurality of twisted pairs of insulated conductors 102 and a cable jacket 104 that reduces alien crosstalk between adjacent cables. More specifically, the cable jacket 104 includes raised or thick areas 106 that increase the cable diameter along one axis 108 of the cable 100 cross-section, effectively increasing the net distance between the pairs of insulated conductors 102 in the cable 100 from twisted pairs of insulated conductors of an adjacent cable (not shown) to reduce alien crosstalk therebetween.

As seen in FIG. 2, the cable jacket 104 of the electrical cable 100 encloses the plurality of twisted pairs of insulated conductors 102 in an inner area 204 defined by the inner perimeter 206 of the cable jacket 104. Although the plurality of twisted pairs of insulated conductors 102 preferably include four pairs of insulated conductors 208, 210, 212, and 214, the electrical cable 100 can include any number of twisted pairs of insulated conductors. A dielectric separator 202 separate from the jacket 104 is disposed in the inner area 204 and separates each twisted pair of insulated conductors 208, 210, 212 and 214 from each other to reduce crosstalk between the individual pairs 208, 210, 212, and 214. As seen in FIG. 2, the inner perimeter 206 of the cable jacket 104 is substantially circular in section transverse to the central longitudinal axis 230 of the cable 100. The dielectric separator 202 preferably has a cross or "+" shape and divides the inner area 204 defined by the inner perimeter 206 into four quadrants with each quadrant supporting one of the twisted pairs of insulated conductors 208, 210, 212 and 214. The dielectric separator 202 is preferably a unitary one-piece member.

The raised areas 106 extend from opposite sides 216 and 218 of the cable jacket 104. The raised areas 106 are substantially thicker than regions 220 and 222 of the cable jacket 104 disposed between the raised areas 106. More specifically, the thickness 224 of the raised areas 106 is about 3 to 4 times the thickness 226 of the regions 220 and 220. The raised areas 106 create a non-circular outer perimeter 228, which has an increased diameter of the cable 100 along its axis 108. The increased diameter of the cable 100 increases the space between the pairs 102 of the cable 100 and the pairs of an adjacent cable, thereby reducing alien crosstalk between the cables.

As seen in FIGS. 1–4, the cable 100 is preferably twisted about its central longitudinal axis 230 so that the raised areas 106 rotate substantially 360° around the cable 100. FIGS. 2–4 show the orientations of the raised areas 106 along the length of the cable 100 after the cable 100 has been twisted. By twisting the cable 100, the raised areas 106 of the cable jacket 104 rotate all the way around the cable 100 and therefore the spacing between the pairs of adjacent cables is maintained on all sides of the cables.

The raised areas 106 and the cable jacket 104 are preferably formed as a unitary one-piece member. Alternatively, the raised areas 106 can be formed separately from the cable jacket 104 and attached to the cable jacket 104. The cable jacket 104 and the raised areas 106 can be formed of a dielectric material, such as PVC or polyolefin low smoke zero halogen.

Although it is preferable to include more than one raised area 106 with the cable jacket 104, a single raised area or more than two raised areas can be employed. Also, the thickness of the entire cable jacket 104 can be increased to reduce alien crosstalk.

Referring to FIG. 5, an electrical cable 500 in accordance with a second embodiment of the present invention, is the same as the cable 100 of the first embodiment, except that the dielectric separator 502 of the cable 500 includes three separate tapes 506, 508 and 510. The three tapes 506, 508, and 510 separate the inner area 504 of the cable 500 into four quadrants with each quadrant supporting one of the twisted pairs of insulated conductors 208, 210, 212 and 214. More specifically, the first tape 506 is substantially straight and divides the inner area 204 into first and second halves 512 and 514 with two of the twisted pairs of insulated conductors 208 and 214 being disposed in the first half 512 and the remaining two pairs 210 and 212 being disposed in the second half 514. The second and third tapes 508 and 510 are each disposed in the first and second halves 512 and 514, respectively. The second tape 508 divides twisted pairs 208 and 214 and the third tape 510 divides twisted pairs 210 and 212. The three separate tapes 506, 508 and 510 are preferably formed of a polymer material.

While particular embodiments have been chosen to illustrate the invention, it will be understood by those skilled in the art that various changes and modifications can be made therein without departing from the scope of the invention as defined in the appended claims.

What is claimed is:

1. A cable, comprising:

a plurality of twisted pairs of insulated conductors;

an insulating cable jacket having a central longitudinal axis and enclosing said twisted pairs of insulated conductors, said cable jacket defining an inner perimeter surrounding said twisted pairs of insulated conductors that is substantially circular in section transverse to said central longitudinal axis and an outer perimeter that is substantially non-circular in section transverse to said central longitudinal axis, said outer perimeter including at least a first raised area defining a first width of said cable jacket, so that said first width is substantially longer than a second width of said cable jacket transverse to said first width, for maintaining spacing from an adjacent cable, thereby reducing alien crosstalk; and first, second and third dielectric separators received in said insulating cable jacket, said first dielectric separator being substantially straight and extending substantially the entire diameter of said inner perimeter of said cable jacket, thereby dividing said inner perimeter into first and second halves, two of said plurality of twisted pairs of insulated conductors being disposed in said first and second halves, respectfully, said second dielectric separator being disposed in said second half and curved between two of said twisted pairs of insulated conductors, and said third dielectric separator being disposed in said first half and curved between two of said twisted pairs of insulated conductors.

2. A cable according to claim 1, wherein said insulating cable jacket and said twisted pairs of insulated conductors are twisted about said central longitudinal axis.

3. A cable according to claim 2, wherein said at least first raised area rotates around said insulating cable jacket.

4. A cable according to claim 1, wherein a separator is disposed within said cable jacket and between said twisted pairs of insulated conductors.

5. A cable according to claim 4, wherein said separator is separate from said cable jacket.

6. A cable according to claim 4, wherein said separator is a dielectric unitary one-piece member.

7. A cable according to claim 4, wherein said separator is a substantially straight polymeric tape.

8. A cable according to claim 4, wherein said separator divides an inner area defined by said inner perimeter of said insulating cable jacket into four quadrants; and each of said quadrants holds one of said plurality of twisted wire pairs.

9. A cable according to claim 1, wherein a thickness of said raised area is substantially greater than a thickness of the remaining of said insulating cable jacket.

10. A cable according to claim 1, wherein said insulating cable jacket is a unitary one-piece member.

11. A cable, comprising:

first, second, third and fourth twisted pairs of insulated conductors;

an insulating cable jacket having a central longitudinal axis and enclosing said first and second twisted pairs of insulated conductors, said cable jacket defining an inner perimeter surrounding said first and second twisted pairs of insulated conductors that is substantially circular in section transverse to said central longitudinal axis and an outer perimeter that is substantially non-circular in section transverse to said central longitudinal axis, said outer perimeter including a first raised area for maintaining spacing from an adjacent cable, thereby reducing alien crosstalk, said insulating cable jacket being twisted about said central longitudinal axis so that said first raised area rotates around said insulating cable jacket; and first, second and third dielectric separators received in said insulating cable jacket, said first dielectric separator being substantially straight and extending substantially the entire diameter of said inner perimeter of said cable jacket, thereby dividing said inner perimeter into first and second halves, said first and second twisted pairs of insulated conductors being disposed in said first and second halves, respectfully, said second dielectric separator being disposed in said second half and curved between said second and third twisted pairs of insulated conductors, and said third dielectric separator being disposed in said first half and curved between said first and fourth twisted pairs of insulated conductors.

* * * * *